United States Patent [19]

Gann

[11] 4,124,354

[45] Nov. 7, 1978

[54] RECYCLING PILOT IGNITION SYSTEM

[75] Inventor: Ronald A. Gann, La Crescenta, Calif.

[73] Assignee: International Telephone and Telegraph Corporation, New York, N.Y.

[21] Appl. No.: 803,142

[22] Filed: Jun. 3, 1977

[51] Int. Cl.[2] ..... F23Q 9/08

[52] U.S. Cl. ..... 431/46; 431/55; 431/71

[58] Field of Search ..... 431/24, 25, 26, 43, 431/45, 46, 51, 54, 55

[56] References Cited

U.S. PATENT DOCUMENTS

| | | | |
|---|---|---|---|
| 2,402,117 | 6/1946 | Shaffer | 431/46 |
| 2,626,657 | 1/1953 | Wilson | 431/25 |
| 3,082,814 | 3/1963 | Pinckaers | 431/46 |
| 3,902,839 | 9/1975 | Matthews | 431/46 |
| 4,019,854 | 4/1977 | Carlson et al. | 431/69 |
| 4,070,143 | 1/1978 | Dietz | 431/43 |
| 4,073,611 | 2/1978 | Kaduki et al. | 431/45 |
| 4,077,762 | 3/1978 | Matthews | 431/25 |

*Primary Examiner*—Carroll B. Dority, Jr.
*Attorney, Agent, or Firm*—A. Donald Stolzy

[57] ABSTRACT

A system including a circuit for igniting or reigniting a pilot burner in a gas fired device each time heat is called for by a thermostat or otherwise. The main burner is ignited by the ignited pilot upon detection of pilot ignition. A sequencing interlock is provided for trial ignition over a limited period of time. An output of a main valve control acting through the sequencing interlock causes sustained actuation of a pilot valve control if the main valve control is actuated.

4 Claims, 8 Drawing Figures

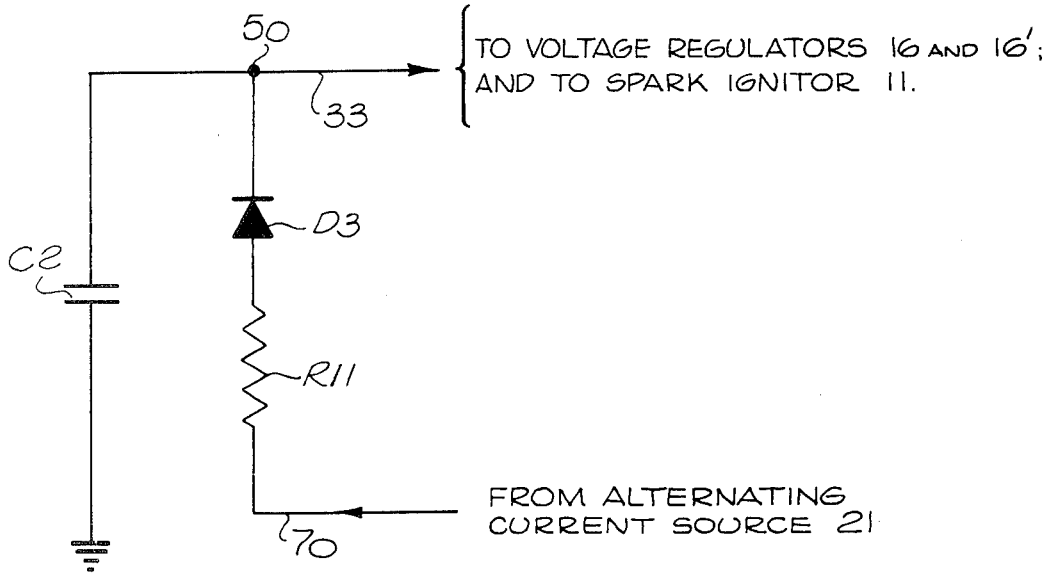
FIG. 2 DIRECT CURRENT SOURCE 17
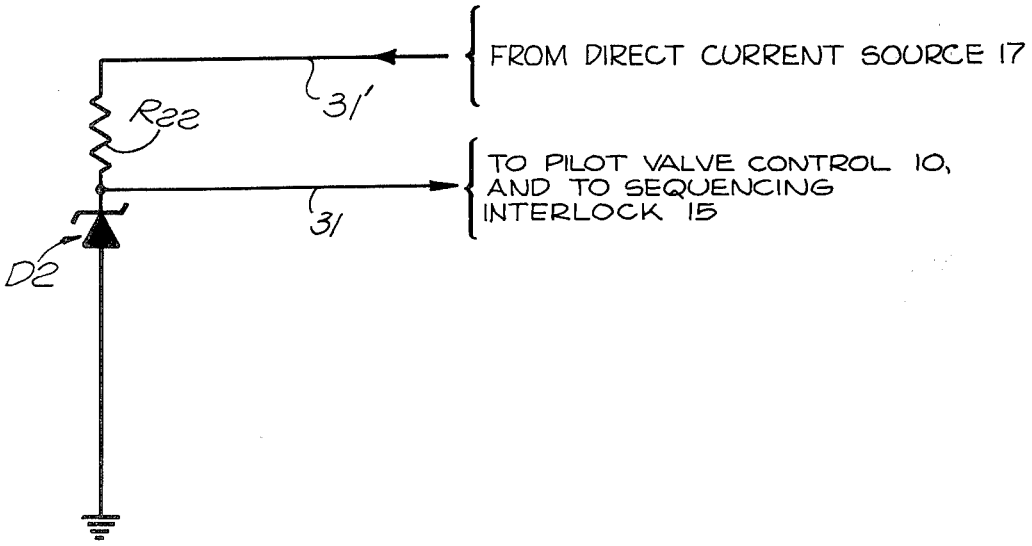
FIG. 3 VOLTAGE REGULATOR 16

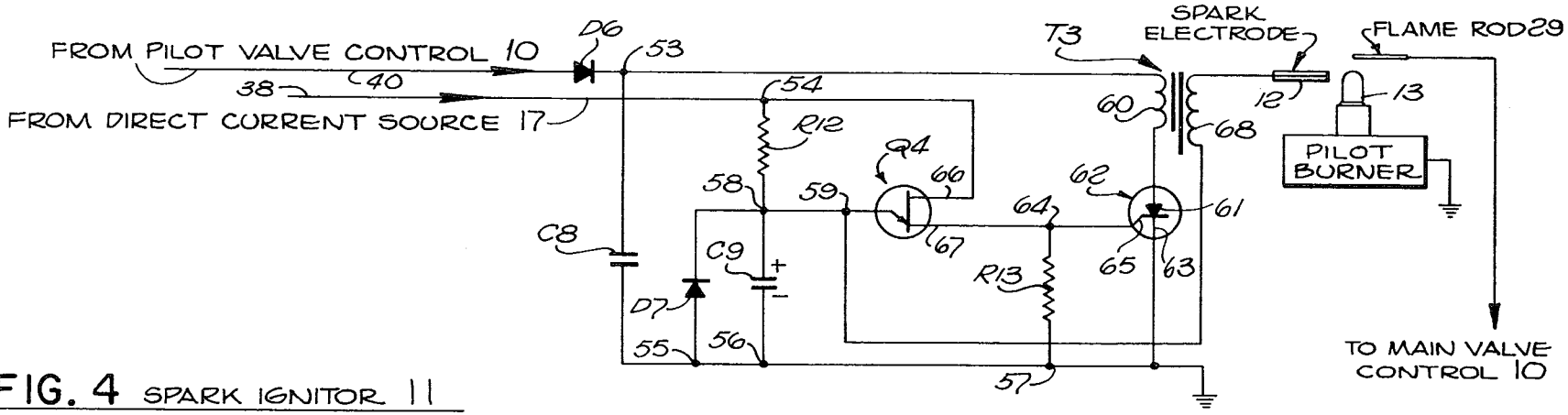
FIG. 4 SPARK IGNITOR 11
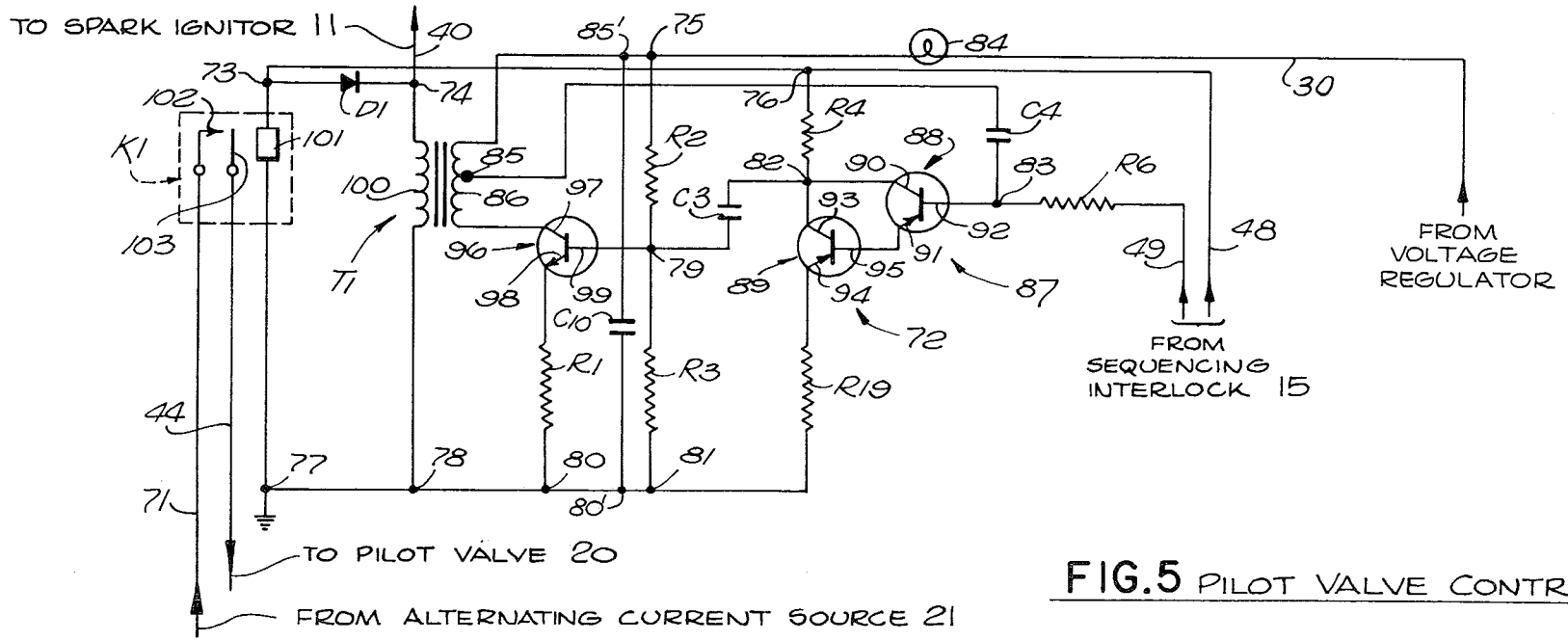
FIG. 5 PILOT VALVE CONTROL 10

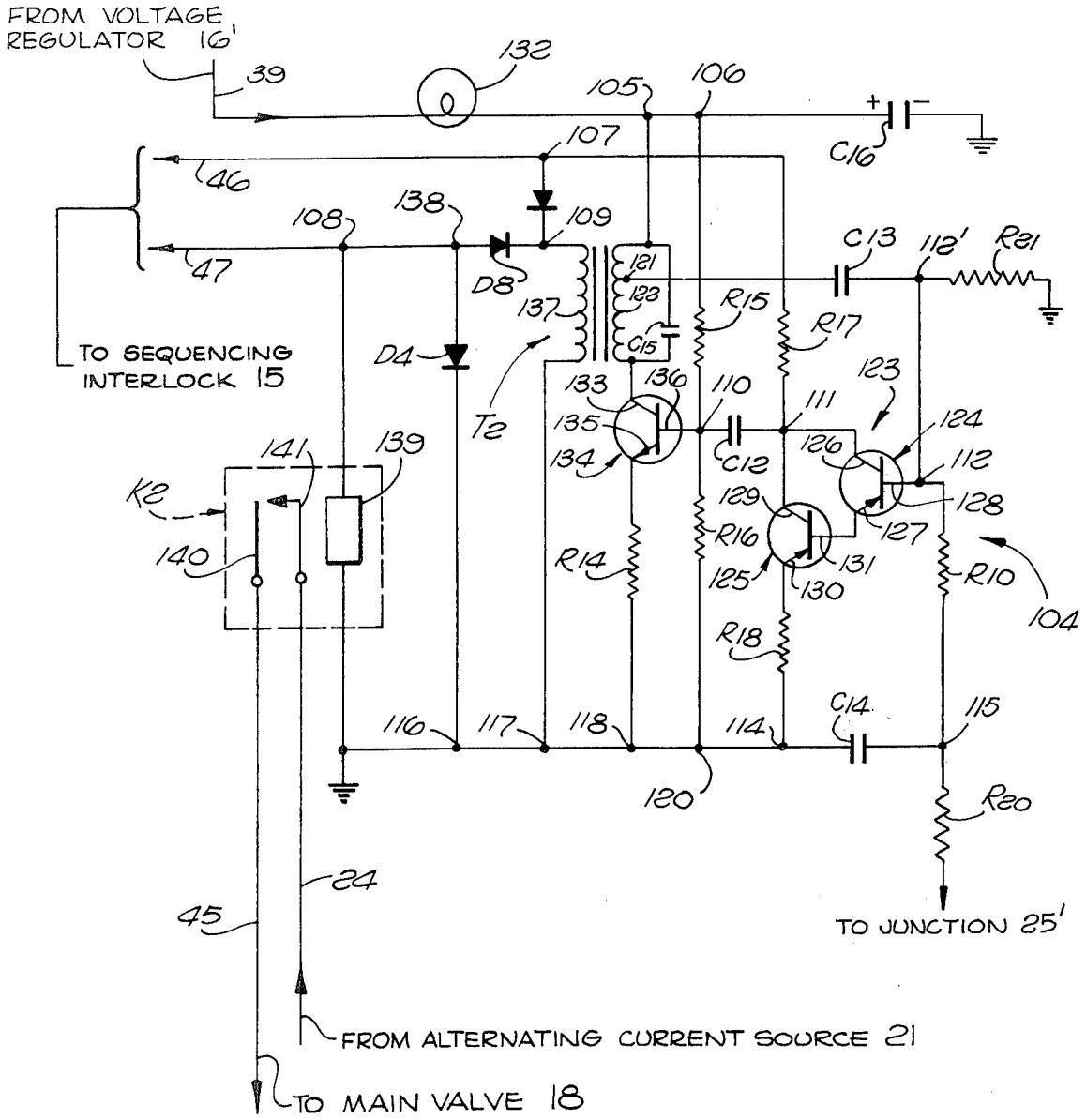
FIG. 6 MAIN VALVE CONTROL 14

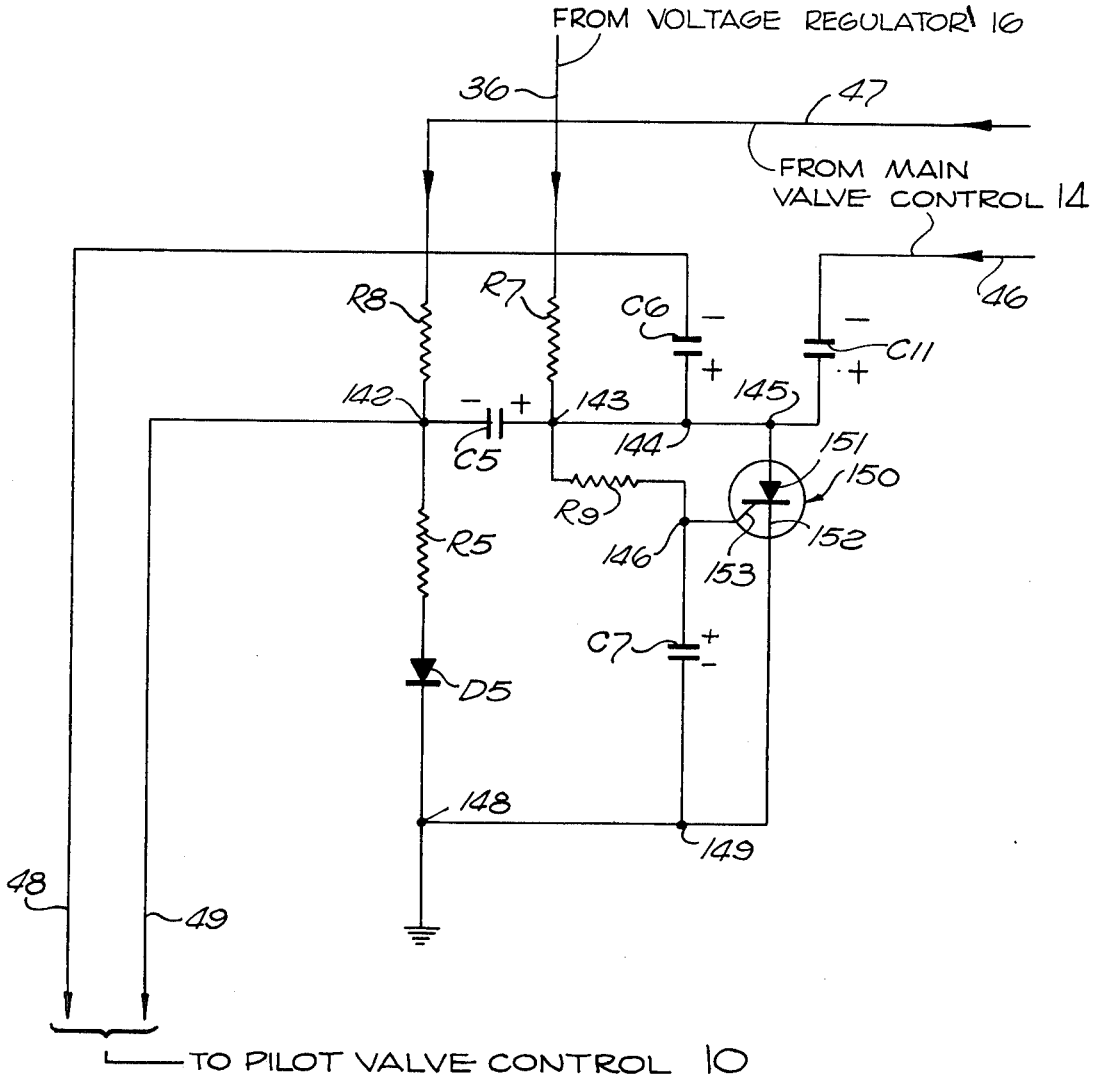
FIG. 7 SEQUENCING INTERLOCK 15

RECYCLING PILOT IGNITION SYSTEM

BACKGROUND OF THE INVENTION

This invention relates to combustion systems, and more particularly to controls for main or pilot valves, and a sequencing interlock for trial ignition or sustained combustion.

The present invention includes a new recycling pilot ignition system, portions of which may be conventional or similar or identical to that disclosed in copending application Ser. No. 661,938 filed Feb. 27, 1976, and now U.S. Pat. No. 4,019,854 by E. A. Carlson et al. for DIRECT SPARK IGNITION SYSTEM UTILIZING GATED OSCILLATOR. The said copending application is hereby incorporated in this application by this reference hereto as though fully set forth herein hereat.

In the past, recycling pilot ignition systems have not been fail safe.

SUMMARY OF THE INVENTION

In accordance with the present invention, the above-described and other disadvantages of the prior art are overcome by providing a heating system comprising: a main burner; a normally closed main valve actuable to admit fuel to said main burner; a pilot burner positioned to ignite fuel emanating from said main burner when fuel emanating from said pilot burner is ignited; a normally closed pilot valve to admit fuel to said pilot burner; a normally deactuated main valve control actuable to open said main valve; an ignitor actuable to ignite fuel emanating from said pilot valve; a normally deactuated pilot valve control actuable to open said pilot valve, said pilot valve control also being connected to said ignitor, said pilot valve control actuating said ignitor when said pilot valve control is actuated; a sequencing interlock responsive to a start signal impressed thereupon to actuate said pilot valve control for a limited time period, sensor means positioned adjacent said pilot burner for producing an output signal when fuel emanating from said pilot burner is ignited, said main valve control being responsive to said sensor means signal and being actuated when said sensor means signal is produced, said main valve control, when actuated, producing a predetermined output signal and impressing the same on said sequencing interlock to cause the same to sustain actuation of said pilot valve control beyond said limited time period, said main valve control, when deactuated during the entire extent of said limited time period, failing to produce said predetermined output signal, said sequencing interlock deactuating said pilot valve control upon the occurrence of said failure, said sequencing interlock also being operated by said main valve control to deactuate said pilot valve control upon failure of said predetermined output signal any time after the end of said limited time period.

According to another embodiment of the present invention there is provided a heating system comprising: a main burner; a normally closed main valve actuable to admit fuel to said main burner; a pilot burner positioned to ignite fuel emanating from said main burner when fuel emanating from said pilot burner is ignited; a normally closed pilot valve to admit fuel to said pilot burner; a normally deactuated main valve control actuable to open said main valve; a normally deactuated pilot valve control actuable to open said pilot valve; an ignitor actuable by said pilot valve control to ignite fuel emanating from said pilot valve, said pilot valve control also being connected to said main valve control, said pilot valve control actuating said ignitor when said pilot valve control is actuated, said pilot valve control impressing a voltage spike on said ignitor and on said main valve control when said ignitor discharges; a sequencing circuit responsive to a start signal impressed thereupon to actuate said pilot valve control for a limited time period; sensor means positioned adjacent said pilot burner for producing an output signal when fuel emanating from said pilot burner is ignited, said main valve control being responsive to said sensor means signal and being actuated when said sensor means signal and said spikes are produced, said main valve control, when actuated, producing a predetermined output signal and impressing the same on a feedback capacitor having a rectifier in series therewith to cause the same to sustain actuation of said main valve control.

The above-described and other advantages of the present invention will be better understood from the following detailed description when considered in connection with the accompanying drawings.

BRIEF DESCRIPTION OF THE DRAWINGS

In the drawings which are to be regarded as merely illustrative:

FIG. 2 is a schematic diagram of a direct current source shown in FIG. 1;

FIG. 3 is a schematic diagram of a voltage regulator shown in FIG. 1;

FIG. 4 is a schematic diagram of a spark ignitor shown in FIG. 1;

FIG. 5 is a schematic diagram of a pilot valve control shown in FIG. 1;

FIG. 6 is a schematic diagram of a main valve control shown in FIG. 1;

FIG. 7 is a schematic diagram of a sequencing interlock shown in FIG. 1; and

DESCRIPTION OF THE PREFERRED EMBODIMENT

Figure 1:
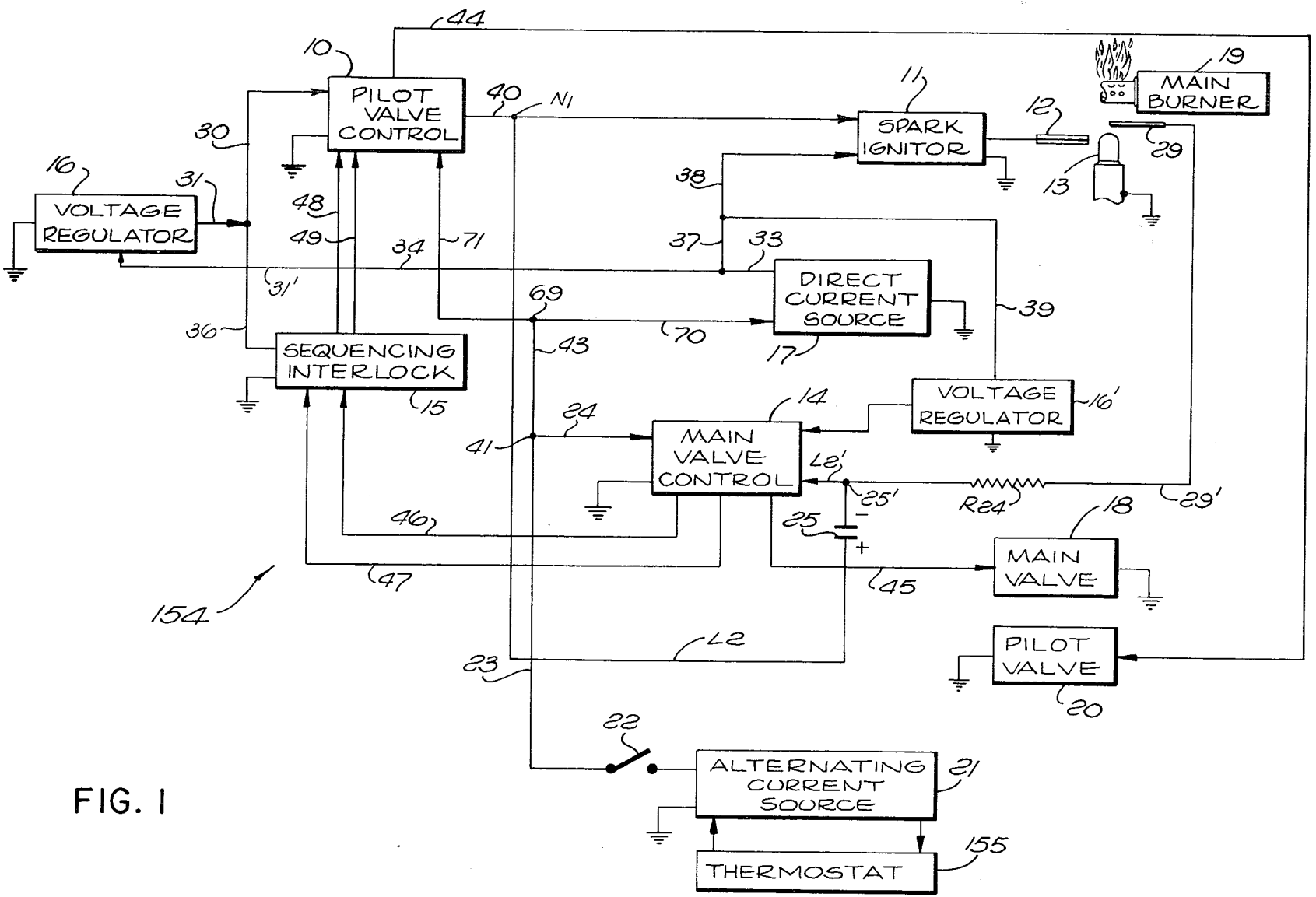
FIG. 1 is a block diagram of one embodiment of the present invention.

In FIG. 1, a pilot valve control is provided at 10. A spark ignitor is provided at 11 having a spark electrode 12 disposed near a gas pilot burner 13.

A main valve control is provided at 14. A sequencing interlock is provided at 15 between main valve control 14 and pilot valve control 10.

Pilot valve control 10 and sequencing interlock 15 have a common voltage regulator 16. Main valve control 14 has a voltage regulator 16'. Both voltage regulators 16 and 16' may be identical to that shown in FIG. 3, if desired.

A direct current source 17 is provided which supplies direct current to voltage regulators 16 and 16' and spark ignitor 11. A main valve 18 and a main burner 19 are also shown in FIG. 1. When actuated, main valve 18 controls the gas to main burner 19. Main burner 19 is positioned near pilot burner 13. A pilot valve 20, when actuated, supplies gas to pilot burner 13.

An alternating current source 21 supplies alternating current through a switch 22 to direct current source 17, main valve control 14 and pilot valve control 10.

Main valve control 14 receives power from source 21 via switch 22, a lead 23, a junction 41 and a lead 24. A conventional flame rod 29 is positioned adjacent pilot burner 13 and is connected to main valve control 14 via lead 29', junction 25' and lead L2'.

A switch (not shown) of a thermostat 155 may be provided, if desired, the thermostat switch being connected in series with switch 22.

When the pilot burner 13 is lit, the flame rod 29 and pilot flame impinging thereon form a high resistance diode poled toward ground. This allows a capacitor 25 to charge with the polarity shown in FIG. 1. Capacitor 25 is connected via lead L2 to junction N1, and to junction 25'. This turns on and sustains an oscillator in main valve control 14. Details of the same will be explained hereinafter. Pilot valve control 10 is connected to regulator 16 via leads 30 and 31. Sequencing interlock 15 is connected to voltage regulator 16 via leads 36 and 31.

Although the leads illustrated in FIG. 1 cannot be adequately explained without reference to the details of the circuits of the blocks in the diagram of FIG. 1, they will be described briefly as follows.

Direct current is supplied from source 17 to main valve control 14 via leads 33, 37 and 39, and through voltage regulator 16'. Current is supplied to sequencing interlock 15 over leads 33, 34, 31 and 36. Current is supplied to spark ignitor 11 over leads 33, 37 and 38.

Pilot valve control 10 is connected to spark ignitor 11 over a lead 40 through junction N1.

Lead 24 is connected from lead 23 at a junction 41 to direct current source 17, direct current source 17 receiving alternating current from lead 43 through a junction 69 and lead 70. Alternating current is supplied to pilot valve control 10 from junction 69 over a lead 71.

Pilot valve 20 is connected from pilot valve control 10 over a lead 44. Main valve 18 is connected from main valve control 14 over a lead 45. Lead 47 is connected from main valve control 14 to sequencing interlock 15. Leads 48 and 49 are connected from sequencing interlock 15 to pilot valve control 10.

Direct current source 17 is shown in FIG. 2 with lead 70 connected to a resistor R11 which, in turn, is connected in series with a diode D3 to a junction 50. A capacitor C2 is connected from junction 50 to ground.

Voltage regulator 16 is shown in FIG. 3 including a resistor R22 and zener diode D2 connected in series in that order from lead 31 to ground.

Leads 31 and 31' are shown in both of FIGS. 1 and 3. Voltage regulators 16 and 16' may be identical, if desired.

In FIG. 4, spark ignitor 11 is shown with input leads 40 and 38. Ignitor 11 is provided with junctions 53, 54, 55, 56 and 57. Junctions 55, 56 and 57 are all connected to ground. Diode D6 is connected from lead 40 to junction 53 and is poled to be conductive in a direction toward junction 53. A capacitor C8 is connected between junctions 53 and 55.

Other junctions are provided at 58 and 59. A resistor R12 is connected from lead 38 and junction 54 to junction 58. A capacitor C9 is connected from junction 58 to junction 56. A diode D7 is connected from junction 55 to junction 58 and poled in a direction to be conductive toward junction 58. Junctions 58 and 59 are connected together. A transformer T3 is provided having one end of its primary 60 connected from junction 53 and the other end connected to the anode 61 of a silicon controlled rectifier (SCR) 62. The SCR 62 has a cathode 63 connected to ground.

A further junction is provided at 64 to which a gate 65 of SCR 62 is connected. A resistor R13 is connected between junctions 64 and 57. A unijunction transistor is provided at Q4 having one base 66 connected from junction 54, and another base 67 connected to junction 64.

Transformer T3 has a secondary 68 which has one end connected to junction 59 and its other end connected to spark electrode 12.

The present invention is by no means limited to the spark ignitor 11 shown in FIG. 4. Many different kinds of ignitors may be substituted therefor without departing from the invention. Nevertheless, the spark ignitor 11 as shown in FIG. 4 may also be used. Its operation is as follows. When a suitable signal is applied to ignitor 11 over lead 40 from pilot valve control 10 supplying alternating current from an oscillator in pilot valve control 10, to be described, capacitor C8 in FIG. 4 charges. When switch 22 and that (not shown) of thermostat 155 (FIG. 1) closes, direct current is supplied over lead 38, and capacitor C9 charges. The potential at junction 58 thus gradually rises until unijunction Q4 fires. This causes SCR 62 to conduct. Thus, if capacitor C8 is then appropriately charged, it discharges into the primary 60 of transformer T3, and a spark jumps from electrode 12 to pilot burner 13. If gas is emanating from pilot burner 13, this gas may then be ignited. A spark is created periodically because capacitor C8 periodically charges and discharges.

Pilot burner 13 then finally becomes lit as will be explained. The connection to the ground of pilot burner 13 of junction 59 through secondary 68 and the pilot flame reduces the resistance between junctions 56 and 58 and no longer allows capacitor C9 to charge to a value sufficient to allow unijunction Q4 to fire.

Pilot valve control 10 is shown in FIG. 5 with leads 30, 48, 49, 44, 40 and 71.

In FIG. 5, a momentary voltage is applied from sequencing interlock 15 over lead 48 to start up the oscillator indicated at 72. At the same time a signal is applied over lead 49 from sequencing interlock 15. The signal over lead 49 is a sustaining signal and keeps the oscillator 72 oscillating so long as the oscillator in the main valve control 14 continues to oscillate. The same is detected by the sequencing interlock 15 and the interlock signal is thus provided over the lead 49. Negative voltages are required for startup of the oscillator 72 and are applied to leads 48 and 49.

In FIG. 5, junctions are provided at 73, 74, 75, 76, 77, 78, 79, 80, 80', 81, 82, 83 and 85'.

As explained previously, lead 30 is provided from voltage regulator 16. A lamp 84 is connected as a circuit element in series with lead 35 to junction 75. Junctions 75 and 85' are connected together. Lead 48 is connected to junction 76. Junctions 73 and 76 are connected together. A resistor R6 is connected from lead 49 to junction 83. A capacitor C4 is connected from junction 83 to a tap 85 on a primary winding 86 of a transformer T1. A Darlington circuit is provided at 87 including transistors 88 and 89. Transistor 88 has a collector 90, an emitter 91 and a base 92. Transistor 89 has a collector 93, an emitter 94 and a base 95. Base 92 is connected from junction 83. Base 95 is connected from emitter 91. Collectors 90 and 93 are connected from junction 82. A resistor R4 is connected between junctions 76 and 82. Emitter 94 is connected through a resistor R19 to a junction 81. Junctions 77, 78, 80, 81' and 81 are connected together. A capacitor C3 is connected between junctions 79 and 82. A resistor R2 is connected between junctions 75 and 79. A resistor R3 is connected between junctions 79 and 81. Capacitor C10 is connected between junctions 85' and 80'.

A third transistor 96 is provided having collector 97, an emitter 98 and a base 99. Base 99 is connected from junction 79. Collector 97 is connected from one end of primary 86. A resistor R1 is connected from emitter 98 to junction 80. The other end of primary 86 is connected to junction 75.

Transformer T1 also has a secondary 100 connected between junctions 74 and 78. A diode D1 is connected between junctions 73 and 74 and poled to be conductive in a direction toward junction 74.

Pilot valve control 10 is provided with a relay K1 having a winding 101 that is energized through diode D1 when oscillator 72 is oscillating. When winding 101 is energized, relay contacts 102 and 103 make and energize pilot valve 20 from source 21.

The main valve control 14 is shown in FIG. 6 having an oscillator 104. Oscillator 104 is provided with junctions at 105, 106, 107, 108, 109, 110, 111, 112, 112', 114, 115, 116, 117, 118 and 120.

A capacitor C13 is connected from a tap 121 on a primary 122 of a transformer T2 to junction 112. Junctions 112 and 112' are connected together. A resistor R21 is connected from junction 112' to ground. A resistor R10 is connected between junctions 112 and 115. A capacitor C14 is connected between junctions 114 and 115. Junctions 116, 117, 118, 120 and 114 are connected to ground. Resistor 20 is connected from junction 115. A Darlington circuit is provided at 123 including transistors 124 and 125. Transistor 124 has a collector 126, an emitter 127 and a base 128. Transistor 125 has a collector 129, an emitter 130 and a base 131. Base 128 is connected from junction 112. Emitter 127 is connected to base 131. Collectors 126 and 129 are connected from junction 111. A resistor R17 is connected between junctions 107 and 111. A resistor R18 is connected from emitter 130 to junction 114.

A capacitor C12 is connected between junctions 110 and 111. A resistor R15 is connected between junctions 106 and 110. A resistor R16 is connected between junctions 110 and 120. A lamp 132 is connected from lead 39 to junction 105. A capacitor C16 is connected from junction 106 to ground. Junctions 105 and 106 are connected together. One end of transformer primary 122 is connected from junction 105 and the other end is connected to a collector 133 of a transistor 134 having an emitter 135 and a base 136. Base 136 is connected from junction 110. Emitter 135 is connected to junction 118 via a resistor R14.

Transformer T2 has a secondary 137 with one end thereof connected to junction 117, and the other end thereof connected to junction 109. A diode D10 is connected between junctions 107 and 109 and poled to be conductive in a direction toward junction 109. A diode D8 is connected between a junction 138 and junction 109 and is poled to be conductive in a direction toward junction 109. A diode D4 is connected between junctions 138 and 116, and poled to be conductive toward the latter.

A relay is provided at K2 having a winding 139 and contacts 140 and 141 connected respectively to leads 45 and 24. Junction 107 is connected to lead 46, and junction 108 is connected to lead 47. A capacitor C15 is connected in parallel with transformer primary 122.

The sequencing interlock 15 is shown in FIG. 7. Sequencing interlock 15 has junctions 142, 143, 144, 145, 146, 147, 148 and 149. Sequencing interlock 15 has resistors R5, R7, R8 and R9. Sequencing interlock 15 has capacitors C5, C6, C7 and C11. Sequencing interlock 15 also has an SCR 150 with an anode 151 connected from junction 145, a cathode 152 connected to junction 149 and a gate 153 connected from junction 146. Capacitor C11 is connected between lead 46 and junction 145. Junctions 143, 144 and 145 are connected together. Capacitor C6 is connected from junction 144 to lead 48. Resistor R7 is connected from lead 36 to junction 143. Capacitor C7 is connected between junctions 146 and 149. Resistor R9 is connected from junction 146 to junction 143. Capacitor C5 is connected between junctions 142 and 143. Resistor R8 is connected between lead 47 and junction 142. Resistor R5 and diode D5 are connected between junctions 142 and 148 in series in that order. Diode D5 is poled to be conductive in a direction toward junction 148. Junctions 148 and 149 are both connected to ground. An output lead 49 from junction 142 is provided to pilot valve control 10 as well as lead 48.

OPERATION

Although the switch of thermostat 155 in FIG. 1 may or may not be provided in series with manual switch 22, one of these two switches must be opened and closed to restart the system once it shuts down. One or both switches may be employed. The word "system" is hereby defined to include, for example only, the structure of FIG. 1 identified by reference numeral 154.

In FIG. 2, direct current source 17 simply employs diode D3 as a rectifier. Capacitor C2 is a smoothing capacitor.

In FIG. 3, voltage regulator 16 includes zener diode D2 which is back biased and breaks down in the conventional way to provide voltage regulation. Improved regulation is provided by capacitor C10.

In operation, manual switch 22 (if used) is closed. The switch (not shown) of thermostat 155 (if used) also closes. This supplies alternating current from source 21 over input leads 23, 43 and 70 to direct current source 17 in FIG. 2. In turn, direct current source 17 in FIG. 2 supplies a D.C. voltage to (1) spark ignitor 11, (2) voltage regulator 16, and (3) voltage regulator 16'. For a brief period, capacitor C9 in spark ignitor 11 of FIG. 4 charges with the polarity shown, and capacitors C5, C6, C7 and C11 charge with the polarities shown in sequencing interlock 15 of FIG. 7. After capacitors C5, C6 and C11 have charged, the increase in charge on capacitor C7 fires SCR 150 and effectively grounds one side of each of capacitors C5, C6 and C11 connected from junctions 143, 144 and 145, respectively. Capacitor C5 through junction 142 and lead 49 then applies a voltage negative and adequate, with its other inputs, to start pilot valve control oscillator 72 shown in FIG. 5. This is for trial ignition. Another negative voltage is supplied to oscillator 72 by capacitor C6 in FIG. 7 over lead 48. Note will be taken that the feedback of oscillator 72 is taken from the tap 85 of transformer primary 86 through coupling capacitor C4, the Darlington circuit 87, coupling capacitor C3 to the base 99 of transistor 96. When oscillator 72 begins to oscillate, capacitor C6 is actually connected in parallel with relay winding 101 and performs a second or dual function. The charge on capacitor C6 is continued by diode D1 so long as pilot oscillator 72 is oscillating. D.C. current is thus supplied to relay winding 101 to close the contacts 102 and 103 of relay K1 and open pilot valve 20. At the same time, the connection to spark ignitor 11 from junction 74 in FIG. 5 over lead 40 supplies an A.C. voltage to spark ignitor 11 over the said lead 40, and the spark ignitor 11 produces a discharge of electricity between electrode 12 and pilot burner 13.

At this point, the pilot burner 13 can fail to ignite or it can be ignited. If it fails to ignite, capacitor C5 in sequencing interlock 15 will lose its charge, and the oscillator 72 of pilot valve control 10 in FIG. 5 will cease oscillation. In this case, the secondary 100 of transformer T1 in FIG. 5 will produce no output either to spark ignitor 11 or to relay winding 101. Thus, the spark ignitor 11 will be shut down and the pilot valve 20 will be closed. This is true because capacitor C5 requires an output from the secondary 137 of the main valve control 14 in order to sustain the oscillation of pilot oscillator 72. No such output will exist if the oscillator 104 of main valve control 14 is not oscillating. Further, it will not be oscillating unless flame rod 29 detects a flame at pilot burner 13.

In accordance with the foregoing, capacitor C5 likewise performs a dual function in that it performs (1) a starting function for trial ignition after charging and after SCR 150 (FIG. 7) has fired. (2) It also, by the connection thereof from transformer secondary 137 in FIG. 6 through diode D8 and resistor R8 (FIG. 7), can receive a charge to sustain oscillation of the pilot oscillator 72. Note again that the rectified current is supplied through R8 (FIG. 7) to pilot valve control lead 49 (FIGS. 5 and 7) through resistor R8 and thence to lead 49 (FIGS. 5 and 7) from junction 142 in FIG. 7.

If, on the other hand, combustible gas emanating from pilot burner 13 is ignited, spark ignitor 11 is shut down after such ignition by connection of the lower end of transformer secondary 68 (FIG. 4) to junction 59 in a well-known manner. Further, as stated previously, with the pilot lit, flame rod 29 acts as a high resistance rectifier which charges capacitor 25 from pilot valve control 10 via leads 40 and L2 as shown in FIG. 1, and supplies a negative voltage to oscillator 104 in the main valve control 14 of FIG. 6 over lead L2'. Capacitor 25 in FIG. 1 thus charges with the polarity shown. From this charge, it will be apparent that flame rod 29 functions the same as a serially connected diode and resistor, the diode being poled to be conductive toward ground.

Capacitor C11 enables oscillator 104 in FIG. 6 to continue oscillation. The charge of capacitor C11 is replenished from the output of transformer secondary 137 through diode D10 (FIG. 6).

Neither of the oscillators 72 and 104 shown in FIGS. 5 and 6 respectively are critical, and other oscillators may be substituted therefor. It will be noted that both of these oscillators are very similar.

After oscillator 104 begins to oscillate, secondary 137 supplies current to relay winding 139,, as before, and contacts 140 and 141 of relay K2 close. This causes main valve 18 to open. Energization of relay winding 139 is sustained by a free-wheeling diode D4.

From the foregoing, it will be appreciated that both of the oscillators 72 and 104 of FIGS. 5 and 6 oscillate when the system 154 is in operation. However, spark ignitor 11 may be shut down after ignition, although it is operational during the trial ignition period determined by the decay of charge on capacitors C5 and C6 in FIG. 7. Note that the charge on capacitor C6 is also sustained if oscillator 72 in FIG. 5 continues to oscillate. This charge is supplied from junction 73 to junction 76 as the current output of secondary 100 is rectified by diode D1. The diode D1 thus has a dual function (1) in keeping C6 charged, and (2) in keeping relay winding 101 energized. Further, C6 acts as (1) a collector supply (transistor 89), and as (2) a smoothing capacitor for relay winding 101. Note that capacitor C6 has one electrode connected from junction 76 (FIGS. 5 and 7.)

Note will be taken that should the pilot flame fail after being ignited, the flame rod 29 will detect that failure; the oscillator 104 in main valve 14 will cease oscillation; the capacitors C5, C6 and C11 in sequencing interlock 15 of FIG. 7 will lose their charge; both oscillators 104 and 72 shown in FIGS. 6 and 5, respectively, will quickly cease oscillation; no voltage will be supplied over lead 40 from pilot valve control 10 to a spark ignitor 11; spark ignitor 11 will be shut down or continue to be shut down; and both relays K1 and K2 in FIGS. 5 and 6, respectively, will deenergize for failure of a signal at transformer secondary 100.

In accordance with the foregoing, the system of the present invention is fail safe in the manner described and in other modes of failure. For example, as stated previously, the system 154 (FIG. 1) cannot be restarted except by opening switch 22 or its equivalent and reclosing the same. This is true because capacitors C5, C6 and C11 cannot charge through resistor R7. In turn, this is true because after SCR 50 has fired, it remains fired until power is removed. Only when power is removed are capacitors C5, C6 and C11 disconnected from ground.

Solid state or other switches may be employed in lieu of relays K1 and/or K2. The same is true of many other or all of the components disclosed herein.

It will be appreciated, too, that one or both of the relays K1 and/or K2 may be completely omitted and any other switch omitted altogether at their respective locations. This is true when oscillators 72 and 104 themselves have outputs sufficiently large to actuate the valves 18 and 20. Other components may also be omitted for various reasons.

Thermostat 155 may be manually operable so that the switch thereof can be opened and closed manually. In this case, switch 22 may be omitted.

The reference characters in the claims refer to the corresponding structures disclosed herein and the equivalents thereof.

The polarity of the direct current supplied as described herein may be reversed if complementary components are used. For example, PNP transistors may be used for NPN and vice versa and/or diode polarities may be reversed, et cetera.

Leads 46, 48 and 49 in FIG. 7 are hereby defined for use herein and in claims to be "input-feedback leads" of pilot valve control 10 inasmuch as they perform both input and feedback functions.

Similarly, lead 49 is hereby defined for use herein and in the claims to be an "input-feedback lead" for main valve control 14.

The invention is made fail safe because oscillators 72 and 104 are employed.

Figure 8:
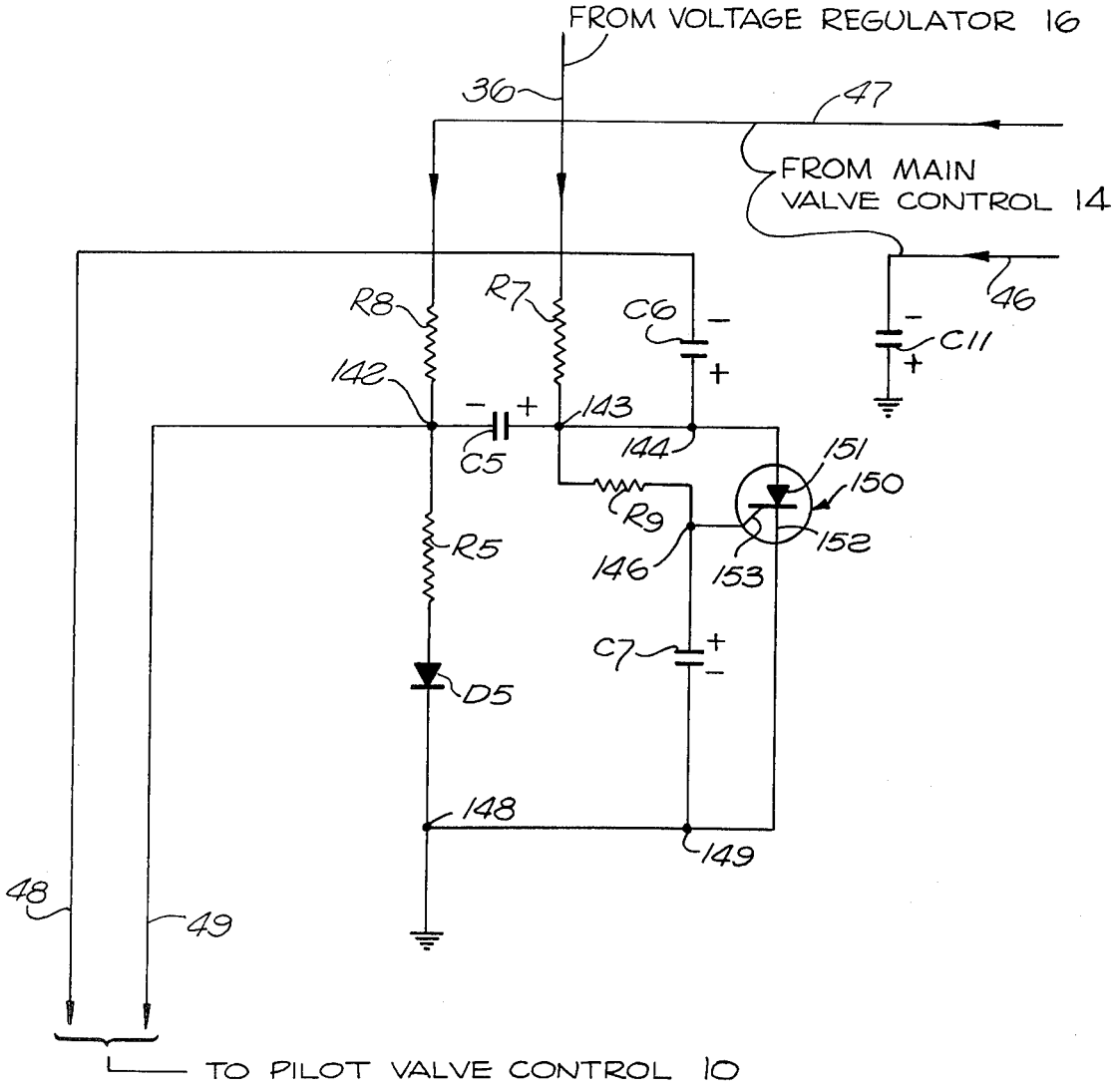
FIG. 8 is an alternate embodiment of a sequencing interlock shown in FIG. 7.

FIG. 8 is identical to FIG. 7 except as follows. In FIG. 8, junction 145 has been removed, but SCR anode 151 then remains connected from junction 144. The lower electrode of capacitor C11' is connected to ground in FIG. 8, whereas capacitor C11 in FIG. 7 has its lower end connected to junction 145. Except as described above, FIGS. 7 and 8 are identical.

The embodiment of FIG. 8 can be used in lieu of that of FIG. 7 because the transient of ignitor 11 firing (FIG. 1) causes junctions N1 and 25', and lead L2 to be grounded. The then and/or subsequent change in the signal on junction 25' will cause capacitor C11' to charge and enable oscillator 104 to oscillate when flame rod 29 detects a pilot flame.

What is claimed is:

1. A heating system comprising: a main burner, a normally closed main valve actuable to admit fuel to said main burner; a pilot burner positioned to ignite fuel emanating from said main burner when fuel emanating from said pilot burner is ignited; a normally closed pilot valve to admit fuel to said pilot burner; a normally deactuated main valve control actuable to open said main valve; a normally deactuated pilot valve control actuable to open said pilot valve; an ignitor actuable by said pilot valve control to ignite fuel emanating from said pilot valve, said pilot valve control also being connected to said main valve control, said pilot valve control actuating said ignitor when said pilot valve control is actuated, said pilot valve control impressing an actuating signal on said ignitor and on said main valve control when said pilot valve control is actuated; a sequencing circuit responsive to a start signal impressed thereupon to actuate said pilot valve control for a limited time period; sensor means positioned adjacent said pilot burner for producing an output signal when fuel emanating from said pilot burner is ignited, said main valve control being responsive to said sensor means signal and being actuated when said sensor means signal and said actuating signal is produced, said main valve control including an oscillator, said main valve control, when actuated, producing a predetermined output signal and impressing the same on a feedback capacitor having a rectifier in series therewith to cause the same to sustain actuation of said main valve control.

2. A heating system comprising: a main burner; a normally closed main valve actuable too admit fuel to said main burner; a pilot burner positioned to ignite fuel emanating from said main burner when fuel emanating from said pilot burner is ignited; a normally closed pilot valve to admit fuel to said pilot burner; an input lead; a circuit; switch means connected from said input lead to said circuit; said switch means having closed and open positions to connect and to disconnect said circuit from said input lead, respectively, said circuit including a normally deactuated main valve control actuable to open said main valve, an ignitor actuable to ignite fuel emanating from said pilot valve, a normally deactuated pilot valve control actuable to open said pilot valve, said pilot valve control also being connected to said ignitor, said pilot valve control actuating said ignitor when said pilot valve control is actuated, a sequencing interlock responsive to the closure of said switch means to actuate said pilot valve control for a limited time period, sensor means positioned adjacent said pilot burner for producing an output signal when fuel emanating from said pilot burner is ignited, said main valve control being responsive to said sensor means signal and being actuated when said sensor means signal is produced, said main valve control, when actuated, producing a predetermined output signal and impressing the same on said sequencing interlock to cause the same to sustain actuation of said pilot valve control beyond said limited time period, said main valve control, when deactuated during the entire extent of said limited time period, failing to produce said predetermined output signal, said sequencing interlock deactuating said pilot valve control upon the occurrence of said failure, said sequencing interlock also being operated by said main valve control to deactuate said pilot valve control upon failure of said predetermined output signal any time after the end of said limited time period, said sequencing interlock including a first capacitor, a first resistor (R7), and a silicon controlled rectifier (SCR) (150), said SCR having an anode, a cathode and a gate, a source connected from said switch means, said source having first and second output leads, said source producing a direct current voltage at said first and second output leads thereof when said switch means is closed, no direct current voltage appearing between said source first and second output leads when said switch means is open, said first resistor being connected from one of said source output leads to said SCR, a second resistor R9 and a second capacitor C7 connected from said one of said source output leads to the other thereof, said second resistor and said second capacitor having a mutual junction connected to said SCR gate, one of said pilot and said main valve controls having an input-feedback lead, said first capacitor being connected from said SCR to said one control input-feedback lead thereof at least to aid in actuation of the same, closure of said switch means causing said first and second capacitors to charge until said first capacitor is connected to the other of said source output leads by firing of said SCR, said one control being adapted to produce a direct current voltage on said feedback lead to sustain the charge on said first capacitor at a value such that said one control can remain actuated.

3. A heating system comprising: a main burner; a normally closed main valve actuable to admit fuel to said main burner; a pilot burner positioned to ignite fuel emanating from said main burner when fuel emanating from said pilot burner is ignited; a normally closed pilot valve to admit fuel to said pilot burner; an input lead; a circuit; switch means connected from said input lead to said circuit; said switch means having closed and open positions to connect and to disconnect said circuit from said input lead, respectively, said circuit including a normally deactuated main valve control actuable to open said main valve, an ignitor actuable to ignite fuel emanating from said pilot, a normally deactuated pilot valve control actuable to open said pilot valve, said pilot valve control also being connected to said ignitor, said pilot valve control actuating said ignitor when said pilot valve control is actuated, a sequencing interlock responsive to the closure of said switch means to actuate said pilot valve control for a limited time period, sensor means positioned adjacent said pilot burner for producing an output signal when fuel emanating from said pilot burner is ignited, said main valve control being responsive to said sensor means signal and being actuated when said sensor means signal is produced, said main valve control, when actuated, producing a predetermined output signal and impressing the same on said sequencing interlock to cause the same to sustain actuation of said pilot valve control beyond said limited time period, said main valve control, when deactuated during the entire extent of said limited time period, failing to produce said predetermined output signal, said sequencing interlock deactuating said pilot valve control upon the occurrence of said failure, said sequencing interlock also being operated by said main valve control to deactuate said pilot valve control upon failure of said predetermined output signal any time after the end of said limited time period, said sequencing interlock including a first capacitor (C5), a first resistor (R7), and a silicon controlled rectifier (SCR) (150), said SCR having an anode, a cathode and a gate, a source connected from said switch means, said source having first and second output leads, said source producing a direct current voltage at said first and second output leads thereof when said switch means is closed, no direct current voltage appearing between said source first and second output leads when said switch means is open, said first resistor being connected from said source first output lead to said SCR anode, said SCR cathode being connected to said source second output lead, a second resistor (R9) and a second capacitor (C7) connected in series with said second resistor from said first to said second source output leads in that order, said first capacitor actuating and deactuating said pilot valve control when charged and discharged, respectively, said second resistor and said second capacitor having a mutual junction connected to said SCR gate, said first capacitor being connected from said SCR anode to both of said pilot and main valve controls for actuation of said pilot valve control, closure of said switch means causing said first and second capacitors to charge unit said first capacitor is connected to said source second output lead by firing of said SCR, said main valve control being actuable to sustain the charge on said first capacitor at a value such that said pilot valve control remains actuated and deactuated by said main valve control when said main valve control is actuated and deactuated, respectively.

4. A heating system comprising: a main burner; a normally closed main valve actuable to admit fuel to said main burner; a pilot burner positioned to ignite fuel emanating from said main burner when fuel emanating from said pilot burner is ignited; a normally closed pilot valve to admit fuel to said pilot burner; a normally deactuated main valve oscillator actuable to open said main valve during oscillation; an ignitor actuable to ignite fuel emanating from said pilot valve; a normally deactuated pilot valve oscillator actuable to open said pilot valve and to actuate said ignitor when oscillating; a sequencing interlock responsive to a start signal impressed thereupon to cause said pilot valve oscillator to oscillate for a limited time period, sensor means positioned adjacent said pilot burner for producing an output signal when fuel emanating from said pilot burner is ignited, said main valve oscillator being responsive to said sensor means signal and being actuated to oscillate when said sensor means signal is produced, said main valve oscillator, when oscillating, producing a predetermined output signal and impressing the same on said sequencing interlock to cause the same to sustain oscillation of said pilot valve oscillator beyond said limited time period, said main valve oscillator, when not oscillating during the entire extent of said limited time period, failing to produce said predetermined output signal, said sequencing interlock deactuating said pilot valve oscillator upon the occurrence of said failure, said sequencing interlock also being operated by said main valve oscillator during failure of oscillation thereof any time after the end of said limited time period to, at that time, deactuate said pilot valve oscillator.

* * * * *